United States Patent [19]

Gallagher

[11] 4,037,268

[45] July 19, 1977

[54] METHOD AND APPARATUS FOR GENERATING A NEGATIVE CHARGE EFFECT IN AN ENVIRONMENT

[75] Inventor: James Cyril Gallagher, Encino, Calif.

[73] Assignee: Apsee, Inc., San Diego, Calif.

[21] Appl. No.: 557,869

[22] Filed: Mar. 12, 1975

Related U.S. Application Data

[63] Continuation of Ser. No. 431,099, Jan. 7, 1974, abandoned, which is a continuation-in-part of Ser. No. 787,872, Dec. 30, 1968, abandoned, which is a continuation-in-part of Ser. No. 394,103, Sept. 2, 1964, abandoned, which is a continuation of Ser. No. 251,616, Jan. 15, 1963, abandoned.

[51] Int. Cl.[2] ..... H01J 3/04

[52] U.S. Cl. ..... 361/231

[58] Field of Search ..... 317/4, 262 AE; 55/101, 55/123, 143, 155; 204/312, 316

[56] References Cited

U.S. PATENT DOCUMENTS

| | | | |
|---|---|---|---|
| 2,744,865 | 5/1956 | Penning | 55/155 |
| 3,081,215 | 3/1963 | Held et al. | 55/155 |

OTHER PUBLICATIONS

"Engineering Materials" by Z. D. Jastrzebski, John Wiley & Sons, Inc., July, 1966, p. 327.

*Primary Examiner*—Harry Moose

*Attorney, Agent, or Firm*—Fulwider, Patton, Rieber, Lee & Utecht

[57] ABSTRACT

Method and apparatus for generating particles having the characteristics and mobility of free electrons. The particles may be dispersed into the environment around the apparatus without circulating air through the apparatus. A relatively high alternating voltage is applied between alternate spaced electrically conductive plates covered with a dielectric material which has high coefficients of secondary electron emission and sufficient dielectric strength to withstand the generation of a cold glow discharge or plasma between facing layers of the material.

8 Claims, 8 Drawing Figures

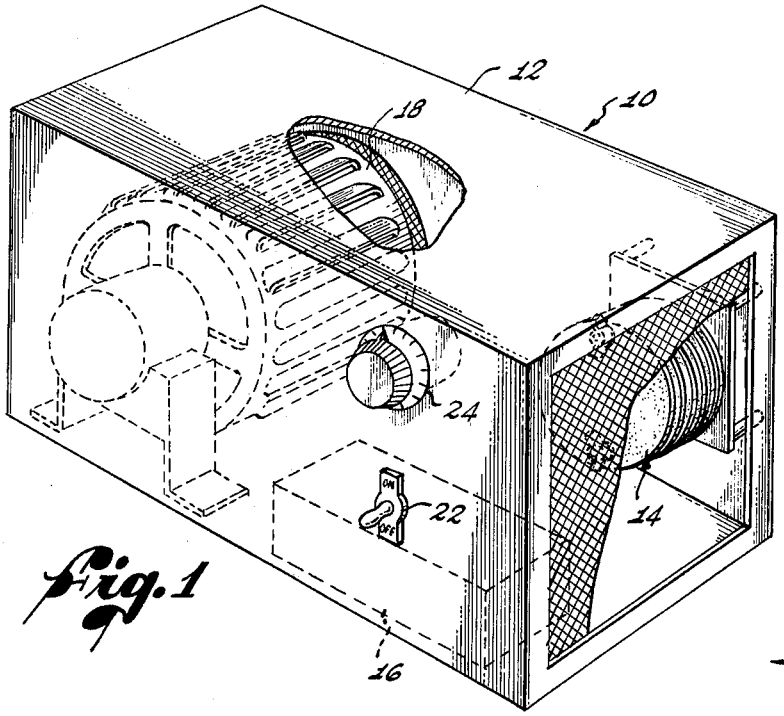
Fig. 1
Fig. 8
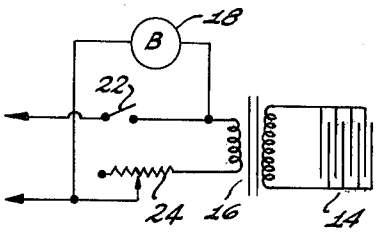
Fig. 2
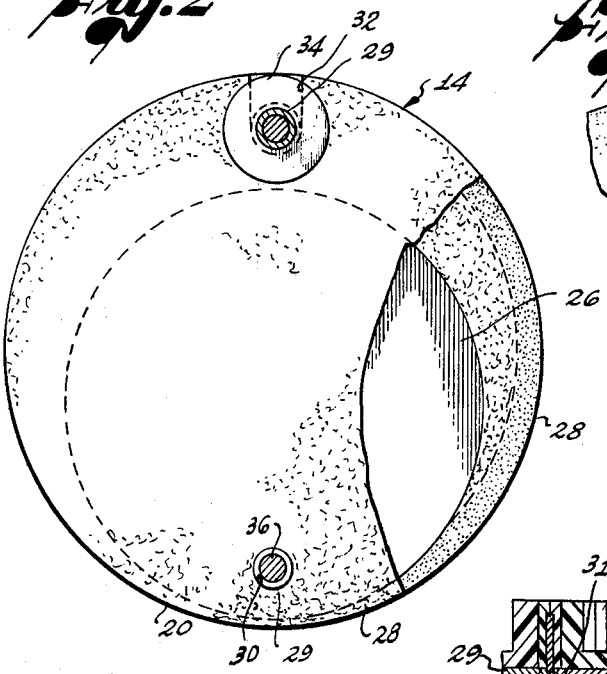
Fig. 6
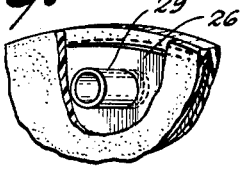
Fig. 3
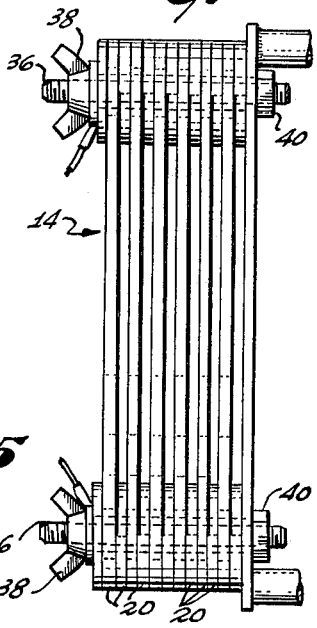
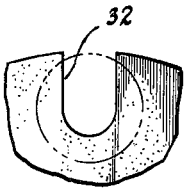
Fig. 5
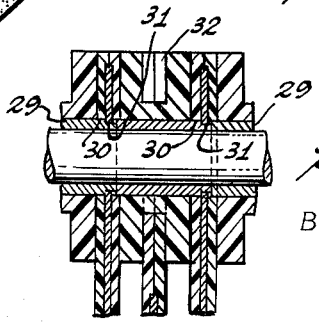
Fig. 4
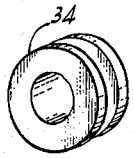
Fig. 7
INVENTOR.
JAMES C. GALLAGHER
BY Fulwider, Patton, Rieber Lee, and Utecht
ATTORNEYS

METHOD AND APPARATUS FOR GENERATING A NEGATIVE CHARGE EFFECT IN AN ENVIRONMENT

CROSS-REFERENCE TO A RELATED APPLICATION

This application is a continuation of Ser. No. 431,099 filed Jan. 7, 1974, now abandoned, which is a continuation-in-part of Ser. No. 787,872 filed Dec. 30, 1968, now abandoned, which is a continuation-in-part of Ser. No. 394,103, filed Sept. 2, 1964, now abandoned, which is a continuation of Ser. No. 251,616, filed Jan. 15, 1963, now abandoned.

BACKGROUND OF THE INVENTION

1. The present invention relates generally to devices for aiding in the removal of dust, odors, and the like from generally enclosed areas such as buildings and rooms and, more particularly, to a method and apparatus which effects such elimination by increasing the negative electric charge in the area.

2. Many types of apparatus have been employed to remove dust, smoke and microscopic or molecular particles causing odors from the air in buildings and the like. Among them are filters, water curtains and electrostatic precipitators which eliminate such particles by passing them through the devices themselves. Other types of apparatus have been used to disperse an ionized gas, such as ozone, which acts directly on organisms, such as microbes and mold spores, at a distance from the apparatus itself. In either case convection air currents must be relied on to either move the air to the cleaning device or to transport the ionized gas particles throughout the area.

A physical phenomenon in the little-known static electricity field is that the earth itself is generally considered to be electrically positive and that small particles generally, and particularly dust, smoke, microscopic particles and organisms in the rooms of buildings also tend to be positive. Therefore, these small particles tend to be repelled by the statically positive floors of rooms and the like resulting from electrostatic induction from the earth. As the mass of such particles is relatively low, the repelling static charge tends to keep the particles floating in the air.

Also, the frictional movement of air through air-conditioing and heating units in a building tends to increase the positive static effect, further enhancing the floating circulation of the small particles.

It has been found that when the generally positive static charge on such particles is neutralized or a slightly negative charge imparted to the particles, the particles are then attracted to the statically positive ground or floor effectively removing them from the circulating air. There has long been a need for a system for imparting negative charges on such particles.

SUMMARY OF THE INVENTION

The method and apparatus of the present invention provides a means for creating and dispersing a negative charge effect by means of an electrical discharge generated between at least two electrically conductive plates covered with layers of a dielectric material. The dielectric material has relatively high coefficients of secondary electron emission due to the impingement of primary electrons, ions and light quanta and also has a dielectric strength sufficient to withstand breakdown in a geometrical and electric field configuration which provides an electric potential between the dielectric layers sufficient to generate a glow discharge or plasma but which also provides an electric potential between the plates themselves which is insufficient to cause the generation of the glow discharge or plasma without the dielectric layers.

A combination of plates, dielectric material and electric potential has been found to generate a relatively large number of free electrons or particles which exhibit approximately the same radiative mobility as free electrons and produce the same effects at great distances from the apparatus generating such particles without requiring circulation of air through the apparatus. The generation of these free particles is theorized to be the result of the secondary emission of electrons during all or a part of the glow discharge which occurs on each half cycle of an alternating voltage applied between the plates of the apparatus. This apparently results in a pulse type of particle generation which maintains a substantially cold glow discharge. Such a mode of operation resists deterioration of the dielectric material in the glow discharge and also substantially prevent the generation of ozone or other noxious gases in the process.

In a presently preferred embodiment of the invention, a high alumina ceramic dielectric satisfies the above requirements for a particular geometrical configuration.

Thus the method and apparatus of the present invention satisfies a long felt need in that a negative charge effect may be induced at great distances without circulating air through the generating apparatus.

DESCRIPTION OF THE DRAWINGS

FIG. 1 is a perspective view of the electrical discharge generator of the present invention, incorporated in a practical portable unit;

FIG. 2 is an elevational view of an individual electrode unit of the generator of the present invention, the electrode unit being partially broken away to show the contained electrically conductive plate, the view being taken in the direction of line 2—2 of FIG. 1;

FIG. 3 is a side elevational view of a plurality of stacked electrode units;

FIG. 4 is an enlarged cross-sectional view of the bus construction utilized in assembling the electrode units of the present invention;

FIG. 5 is a fragmentary view of a portion of an electrode unit showing an assembly notch in an electrode unit with its associated insulating washer shown in phantom;

FIG. 6 is a fragmentary perspective view of a portion of an electrode unit showing an inteconnecting spacer construction;

FIG. 7 is a perspective view of the insulating washer associated with the assembly notch of an electrode unit; and FIG. 8 is an electrical schematic diagram of the practical portable unit shown in FIG. 1.

DESCRIPTION OF THE PREFERRED EMBODIMENT

Referring now to the drawing, FIG. 1 shows a commercially practical, portable negative charge generating unit 10. A generally rectangular housing 12 contains an electrical discharge generator 14, a transformer 16 and a blower 18. The electrical discharge generator 14 comprises a plurality of stacked, spaced, disc-like electrode units 20 and is mounted within the housing 12 so that the blower 18 can move a small amount of air between the stacked electrode units. The transformer 16 steps up 60 cycle A.C. line voltage to a relatively high A.C. voltage which is applied between alternate electrode units 20 of the electrical discharge generator 14. As is shown in FIG. 8 a switch 22 controls the power to both the transformer 16 primary winding and the blower 18. Additionally, a rheostat 24 is provided between the line voltage and the one side of the primary of the transformer 16 to control the voltage applied to the primary and, consequently, the A.C. voltage level developed by the secondary of the transformer.

The maximum secondary voltage developed by the transformer 16 for the preferred embodiment illustrated is approximately 5000 volts RMS (≈7000 peak volts) and it has been found that varying the voltage applied between alternate electrode units 20 of the generator 14 varies the negative static charge generating effect of the generator. The voltage control for the portable unit 10 is provided to allow adjustment of the level of charge generation as the area becomes negatively statically charged.

The electrical discharge generator 14 of the present invention is generally illustrated in FIGS. 2 and 3. Each electrode unit 20 of the generator 14 generally comprises a disc-like electrically conductive plate 26 covered on either side by a layer 28 of electrically insulating or dielectric material. For some dielectric materials, the plate 26 may be encapsulated in the material. In the illustrated embodiment, the covering layers 28 are formed into a somewhat larger disc with the plate 26 eccentrically aligned between the sheets.

To provide a means for electrically interconnecting alternate electrode units 20 in a stack, one end of a tubular, electrically conductive spacer 29 is physically and electrically connected to one side of the plate 26 through an opening 30 in the layer 28 of dielectric material. The end of the spacer 29 fits into a hole 31 in the plate 26 near the edge of the electrode unit 10 where the plate is nearest the edge. The spacer 29 is securely fastened to the plate 26 for good electrical contact. An aligned hole (not shown) through the opposite layer 28 of dielectric material exposes the end of the spacer 29 and hole 31 in the plate 26.

A notch 32 is cut in the edge of the electrode unit opposite the spacer 30 for receiving a grommet type insulating washer 34. The notch 32 is not deep enough into the edge to cut into the plate 26.

When the individual electrode units 20 are assembled into an electrical discharge generator 14, each spacer 30 passes through the insulating washer 34 of an adjacent electrode unit and makes contact with the plate 26 and spacer of the next adjacent electrode unit so that alternate electrode units are electrically interconnected. An assembly rod 36 passes through the aligned spacers 29 and the threaded exposed ends of the rod are fitted with nuts 38, 40. The nuts are tightened to compress the ends of the aligned spacers 29 into a good physical and electrical contact. The result is a tubular electrical bus providing good electrical contact between alternate plates 26 to prevent high voltage arcing around the interconnections between alternate electrode units 20.

For the preferred portable embodiment of the generating unit 10 illustrated in FIG. 1, utilizing a maximum A.C. voltage between electrode units 20 of 5000 volts RMS (≈7000 peak volts), the electrode units are assembled so that there is an air space between layers 28 of dielectric material of approximately 0.165 centimeters. The layer 28 of dielectric material is preferably 0.066 centimeters thick for reasons developed below.

While a preferred embodiment for a practical negative static charge generating unit 10 is shown in FIG. 1, it should be noted that any means for moving air between the electrode units 20 of the electrical discharge generator 14 may be employed. Thus, in larger commercial installations the generator 14 may be placed in the ducting of the air-conditioning or heating system of a building or the like.

DEVELOPMENT OF CRITERIA FOR IONIZATION AND SECONDARY EMISSION OF ELECTRONS

The theory of operation of the invention requires a general consideration of the ionization of a gas, particularly air, between two spaced, parallel, conductive plates with an electrical potential between them.

The increase in electrons $dn$ by ionization resulting from an original $n$ electrons over a distance $dx$ is commonly stated as:

$$dn = \alpha n dx \tag{1}$$

where $\alpha$ is the first Townsend ionization coefficient, which is a function of the type of gas, the Pressure P of the gas and the electric field intensity E.

Then, assuming that $N_0$ is the number of electrons emitted from a cathode and $d$ is the distance from the cathode to the anode, integration of equation (1) yields the number of electrons (N) reaching the anode, or:

$$N = N_0 e\alpha^d. \tag{2}$$

Under the proper conditions, the electrons traveling from cathode to anode produce ions in transit producing a glow type of discharge or a plasma environment between the cathode and anode. At the anode, the secondary emission of electrons occurs due to various factors:

I. An electron strikes the anode surface and causes secondary emissions of electrons with a coefficient $\delta$.

II. Ions strike the anode surface and also cause the secondary emission of electrons with a coefficient $\gamma$.

III. The light quanta in the glow discharge strikes the anode surface and causes a secondary emission of electrons with a coefficient $\gamma_p$.

It should be noted that the secondarily emitted electrons are normally at a much lower energy level than the primary electrons.

Considering a single electron leaving the cathode, it can be seen from equation (2) that the number of ions produced in transit to the anode will be:

$$e\alpha^d - 1 \tag{3}$$

and the number of secondary electrons produced at the anode by those ions will be:

$$\gamma(e\alpha^d - 1). \tag{4}$$

The creation of the secondary electrons produces more ions which, in turn, produces more electrons resulting in a geometric increase in the production of secondary electrons generally described as:

$$N = N_o e\alpha^d \left[ 1 + \sum_{n=1}^{\infty} \{\gamma(e\alpha^d - 1)\}^n \right] \quad (5)$$

which reduces to:

$$N = \frac{N_{oe}\alpha d}{1 - \gamma(e\alpha^d - 1)} \quad (6)$$

and the current is given as:

$$I = eN = \frac{eN_{oe}\alpha d}{1 - \gamma(e\alpha^d - 1)} \quad (7)$$

It can be seen that the breakdown condition occurs as $\gamma(e\alpha^d - 1)$ approaches unity or:

$$\gamma(e\alpha^d - 1) = 1. \quad (8)$$

To determine the breakdown voltages needed to produce the desired discharge it is necessary to examine the properties of $\alpha$, the first Townsend coefficient. For any gas, or air, it can be experimentally shown that $\alpha$, P and E are generally functionally related as follows:

$$\alpha/P = f(E/P) \quad (9)$$

For air and various gases, this relationship has been experimentally shown to satisfy the expression:

$$\frac{\alpha}{P} = Ae^{\frac{-B}{(E/P)}} \quad (10)$$

where the coefficients $A$ and $B$ have known tabulated values for ranges of $E/P$. In particular, for air, $E/P$ ranges from 40 to 800 (volts/cm), $A = 15$ ($k$/cm) (mm Hg) and $B = 365$($v$/cm)/(mm Hg).

Equations 8 and 10 may be related by substituting $$(\alpha/P)(Pd) = \alpha d \quad (11)$$

in equation 8 and then further substituting equation 10 in the result.

This manipulation produces an expression for the breakdown starting electric field of:

$$\frac{E_s}{P} = \frac{B}{C + \log_e(Pd)} \quad (12)$$

where $$C = \log_e\left\{\frac{A}{\log_e(1 + 1/\gamma)}\right\} \quad (13)$$

and the starting potential is then:

$$V_s = \frac{B(Pd)}{C + \log_e(Pd)} \quad (14)$$

which agrees substantially with observed results.

Relating this relationship to a specific geometry, dielectric covered metal plates are spaced so that the dielectric surfaces are ($b$) centimeters apart and the dielectric layers are each ($a$) centimeters thick. The metal plates are then ($2a+b$) centimeters apart.

The following quantities are then defined to determine the opeating conditions for the specific geometry:

$E_s$ = starting potential $E_e$ = potential (Volts) applied between the metal plates $E_a$ = potential (Volts) across the air gap between the dielectric layers $E_c/2$ = potential (Volts) across each of the dielectric layers $\epsilon_1$ = electric inductive capacity of the dielectric layers $\epsilon_2$ = electric inductive capacity of the air.

The proper operating conditions can best be illustrated by an example using the materials and dimensions of a presently preferred embodiment. It should be noted, however, that any other configuration which meets the criteria described herein could also be used.

The presently preferred embodiment employs a dielectric material which is a high alumina ceramic with relatively high secondary electron emission coefficients ($\delta$, $\gamma$ and $\gamma_p$) described above. The metal plates are preferably made of stainless steel and the following dimensions are employed:

$a$ = 0.066 centimeters $b$ = 0.165 centimeters $\epsilon_1$ = 9.3 (normalized inductive capacity of dielectric material)

$\epsilon_2$ = 1.0 (normalized inductive capacity of air).

From the discussion above, the minimum value of $E/P$ is 40 which will be used to define minimum potentials for the proper operation of the generator. In particular, for a nominal air pressure of 760 (mm Hg):

$$E_s/P = 40, \quad (15)$$

$$E_s = 40P = 40 \times 760 = 30{,}400 \text{ (Volts/cm)} \quad (16)$$

The starting voltage across the metal plates alone is then:

$$V_{s1} = E_s \cdot (2a+b) = 9028.8 \text{ Volts.} \quad (17)$$

The starting breakdown voltage across the air gap between the dielectric layers is then:

$$V_{s2} = E_s \cdot b = 5016 \text{ Volts.} \quad (18)$$

It can therefore be seen that the minimum potential $E_a$ between the dielectric layers to sustain the glow discharge, or plasma, is:

$$E_a > V_{s2} = 5016 \text{ Volts.} \quad (19)$$

It can also be seen that the potential between the metal plates $E_e$ must be higher than $V_{s2}$ but below the minimum value to maintain, $$9028.8 = V_{s1} > E_e > V_{s2} = 5016 \text{ Volts.} \quad (20)$$

The potential $E_c/2$ across each dielectric layer to avoid breakdown of the layer is:

$$\frac{E_c}{2} < V_{DS} \cdot a \quad (21)$$

where $V_{DS}$ is the dielectric strength (volts/cm) of the dielectric material which, for the chosen ceramic is:

$$V_{DS} = 8.3 \times 10^4 V/\text{cm}.$$

Therefore, the condition to void dielectric breakdown is:

$$(E_c/2) > 5478 \text{ Volts.} \quad (22)$$

To determine the actual operating conditions for the example, we consider the total voltage across the electrodes with the electric field across the dielectrics as $E_1$ and the electric field across the air gap as $E_2$. Then the total voltage $E_e$ is:

$$E_e = E_1 d_1 + E_2 d_2 \quad (23)$$

where $d_1$ is the total width of both dielectric layers and $d_2$ is the width of the air gap.

The flux density $D$ through the dielectric layers and the air gap must be the same so that $$\epsilon_1 E_1 = \epsilon_2 E_2 \quad (24)$$

where $\epsilon_1$ and $\epsilon_2$ are as defined above. Then, combining equations 23 and 24, we get $$E_1 = \frac{E_e}{d_1 + \epsilon_1/\epsilon_2 \cdot d_2} \quad (25)$$

$$E_2 = \frac{E_e}{\epsilon_2/\epsilon_1 \, d_1 + d_2} \quad (26)$$

For the particular example, $$d_1 = 2a,$$
$$d_2 = b_1$$
$$E_c = E_1 \cdot 2a,$$
$$E_a = E_2 \cdot b$$

and substituting in equations 25 and 26, we get:

$$\frac{E_c}{2} = \frac{E_e \cdot a}{2a + \epsilon_1/\epsilon_2 \, b} \quad (27)$$

and $$E_a = \frac{E_c \cdot b}{\epsilon_2/\epsilon_1 \cdot 2a + b} \quad (28)$$

A nominal working voltage of $E_e = 7{,}000$ peak volts was experimentally chosen, resulting in $$E_c/2 \approx 277 \text{ volts,}$$

and $$E_a \approx 6445 \text{ volts}$$

both of which values satisfy equations 19, 20 and 21 above.

Operating the electrical discharge generator 14 appears to have the effect of inducing a negative static electric charge in walls, ceilings, objects in a room, and small or microscopic particles in the air for some considerable distances beyond the operating point of the unit 10. Thus, the negative static effect does not appear to be the result of ionized particles carried by the airstream emanating from the unit 10.

Depending on the composition of the dielectric material covering the plates 26, the electrical discharge generator can be successfully operated at voltages high enough to produce the negative static charge effect without the dielectric material deteriorating or decomposing until it eventually breaks down.

The effect of the negative static charge produced by the operation of the electrical discharge generator 14 can best be illustrated by actual examples.

After an electrical discharge generator was installed in the air-conditioning system serving the cafeteria and supply distribution areas of a hospital, the hospital officials reported a reduction in food and cigaret odors almost to the point of complete elimination. A gradual removal of smoke and dust deposits around the air-conditioning diffusers, ceiling and curtains was also reported.

Another hospital reported that a very penetrating odor was substantially eliminated both from the source of the odor and the adjoining halls and rooms when a portable unit, similar to that illustrated in FIG. 1, was operated near the source of the odor.

When the output of an electrical discharge generator was introduced into the air intake of one test blower of a glass container factory it was reported that the fan blades, housing and duct walls of the test blower stayed clean while the fan blades, housing and duct walls of other blowers operating in the same room became dirty very quickly.

Flour dust is a major problem in bakeries and it was reported that, after a portable unit was operated in the bakery for a period of time, the air-borne flour dust was reduced by 70% and that the dust mainly settled to the floor instead of floating in the air. It was also reported that the flour, instead of floating in the air, tended to remain on the floor even after it was agitated rather vigorously with a broom. A more controlled test procedure was used to determine the effect of the operation of a generator on airborne microbes. Six types of microbes in controlled quantities were used. The quantities of the test microorganisms were standardized prior to use and nebulized into the air intake of a portable unit operating at full power setting. Each 24 hours for a 7-day period thereafter sterile plates were exposed and incubated. It was reported that there was a very definite decrease in the airborne organisms as a result of operation of the electrical discharge generator.

Static electricity appears to be substantially neutralized by the negative static charge effect produced by the electrical discharge generator. A bakery reported that static electricity had been a problem in the wrapping department and that at times rolls of polypropylene wrapping material had to be returned to the mill for rerolling to remove the static charge. About 6 weeks after the installation of a portable electrical discharge generating unit the bakery reported that the problem had been practically eliminated.

While the reason is not known, it appears that the measurable carbon dioxide content in air appears to be reduced by operation of an electrical discharge generator. To confirm this effect two series of tests were run by an independent testing laboratory. The first test was made with an electrical discharge generator in normal atmosphere and showed a 12% reduction in the carbon dioxide content of the airstream. The second test was made with the generator incorporated in a closed recirculating system and resulted in a 23.2% reduction in the carbon dioxide content after recirculating the air for 15 minutes. Continued recirculating the air for an additional hour and a half resulted in the removal of about 88% of the carbon dioxide.

The report of the laboratory indicated that the results of the experiments were unexpected and unexplainable. The report also indicated that the reduction of the carbon dioxide content in every experiment was a sufficient indication that it was a result of the operation of the electrical discharge generator.

The concentration of nitrogen oxides in the air appear to be reduced by the operation of the generator because, after the generator was stopped but the air circulation continued, there was a noticeable increase of these oxides during the tests.

A particularly successful dielectric material used for covering the plates 26 of the electrode units 20 is a high-alumina ceramic composition. Another practically successful covering for the plates 26 has been a glass composition material bound together with a small amount of organic melamine, the material being known as glass melamine. For a maximum voltage of approximately 5000 volts RMS with a spacing of approximately 0.065 inches between dielectric surfaces, successful operation can be maintained with a glass melamine dielectric thickness of approximately 0.045 inches.

The glass melamine can be used alone but there are organic substances at the surface of the dielectric covering which deteriorate somewhat resulting in a breakdown of the electrode units 20. To eliminate the deterioration various coatings may be applied to the glass melamine base covering. Among the coatings which have been successful in varying degrees are polytetrafluoroethylene, polypropylene, polyethylene terephthalate, vinylidene chloride, potassium silicate, lithium silicate and a one-component ambient curing material based on a dimethylsiloxane resin available commercially as Dow Corning F-195. A particularly successful organic material used to coat the glass melamine is a moisture-cured polyurethane based on a linear aliphatic diisocyanate known as LAMINAR 48-C-27 available from Magna Coatings & Chemical Corporation of Los Angeles, Cal.

It should be apparent from the above discussion that the criteria for successful generation of the electric negative charge effect is the selection of a dielectric material which exhibits relatively high coefficients of secondary electron emission and sufficient dielectric strength to resist breakdown when subjected to the electrical potentials necessary to produce the glow discharge or plasma. Practically, the dielectric material must be workable into the required configuration.

While the particular preferred embodiment for a portable negative static charge generating unit has been described and illustrated and particular dielectric materials used for covering the plates of the electrode units have been described, it will be appreciated that various modifications of the physical arrangement of the present invention can be made and that various other dielectric materials may be suitable and may be used without departing from the spirit and scope of the invention. The invention, therefore, is not to be limited except by the following claims.

I claim:

1. An electrical discharge generator comprising:

at least two electrode units each having an electrically conductive plate covered by a dielectric material, said electrode units being in a spaced parallel relationship and the facing surfaces of said electrode units having high coefficients of secondary electron emission; and means for applying an electrical potential between said electrode units, said electrical potential being sufficient to generate a glow type of discharge between said facing surfaces.

2. The electrical discharge generator of claim 1 wherein said dielectric material is of a high-alumina ceramic composition.

3. The electrical discharge generator of claim 1 wherein said electrical potential difference is alternating; and said dielectric material is of a high-alumina ceramic composition.

4. The electrical discharge generator of claim 3 including means for moving air between said spaced electrode units.

5. The electrical discharge generator of claim 1 wherein:

said facing surfaces of said electrode units are spaced a distance of ($b$) centimeters;

said dielectric material has a thickness of ($a$) centimeters;

the electric field required to start said glow type of discharge is $E_s$ (volts/cm);

the electric potential across the air space between said facing layers ($E_a$) is greater than $E_s \cdot b$;

the electric potential applied between the conductive plates $E_e$ is less than $E_s(2a+b)$, but greater than $E_s \cdot b$; and the electric potential across the thickness of the dielectric material $E_c/2$ is less than $V_{DS} a$ where $V_{DS}$ is the dielectric strength of the material in volts per centimeter.

6. The electrical discharge generator of claim 5, wherein:

said electric field ($E_s$) required to start said glow type of discharge is at least 30,400 volts/cm.

7. The electrical discharge generator of claim 5 wherein:

said facing surfaces are spaced at 0.165 centimeters;

said dielectric material has a thickness of 0.066 centimeters; and said dielectric strength is at least 83,000 volts/centimeter.

8. The electrical discharge generator of claim 5, wherein:

said dielectric material is selected from the group consisting of a substantially inorganic material, potassium silicate, lithium silicate, a high-alumina ceramic and glass melamine coated with potassium silicate or lithium silicate.

* * * * *

UNITED STATES PATENT AND TRADEMARK OFFICE

CERTIFICATE OF CORRECTION

PATENT NO. : 4,037,268

DATED : July 19, 1977

INVENTOR(S) : James Cyril Gallagher

It is certified that error appears in the above–identified patent and that said Letters Patent are hereby corrected as shown below:

Column 5, formula (5) should read:

$$N = N_o e^{\alpha d} \left[ 1 + \sum_{n=1}^{\infty} \{\gamma(e^{\alpha d}-1)\}^n \right]$$

formula (6) should read:

$$N = \frac{N_o e^{\alpha d}}{1-\gamma(e^{\alpha d}-1)}$$

formula (7) should read:

$$I = eN = \frac{eN_o e^{\alpha d}}{1-\gamma(e^{\alpha d}-1)}$$

Column 6, line 4, "opeating" should be --operating--.
Column 7, line 7, ">" should be --<--; line 37, "$d_2=b_1$" should be --$d_2=b_1$--.

Signed and Sealed this

Eleventh Day of April 1978

[SEAL]

Attest:

RUTH C. MASON
Attesting Officer

LUTRELLE F. PARKER
Acting Commissioner of Patents and Trademarks